US005375700A

United States Patent [19]

Joss et al.

[11] Patent Number: 5,375,700

[45] Date of Patent: Dec. 27, 1994

[54] CUTLERY AND ACCESSORY PACKAGING AND DISPLAY CARTON

[75] Inventors: Mike Joss, Chicago; Gordon Ruhnke, Oak Forest; Dave Sarmento, Vernon Hills, all of Ill.

[73] Assignee: JMP-Newcor International, Inc., Skokie, Ill.

[21] Appl. No.: 77,239

[22] Filed: Jun. 14, 1993

[51] Int. Cl.[5] ..... B65D 79/00; B65D 5/50

[52] U.S. Cl. ..... 206/45.13; 206/45.14; 206/461; 206/471; 206/553; 229/1.5 C

[58] Field of Search ..... 206/44.11, 45.14, 45.13, 206/542, 553, 461, 471; 229/103.1, 1.5 C, 156

[56] References Cited

U.S. PATENT DOCUMENTS

| | | | |
|---|---|---|---|
| D. 314,914 | 2/1991 | Callinan | D9/414 |
| 1,553,827 | 9/1925 | Lee | 206/44.11 |
| 1,844,189 | 2/1932 | Stuart | 206/44.11 |
| 2,509,616 | 5/1950 | Rafoth et al. | 229/1.5 C |
| 2,643,811 | 6/1953 | Bolding | 206/44.11 |
| 2,700,456 | 1/1955 | Gillam | 206/45.14 |
| 2,767,831 | 10/1956 | Brecht | 206/45.31 |
| 2,854,182 | 9/1958 | Dodd | 229/27 |
| 3,033,357 | 5/1962 | Vogel | 206/45.31 |
| 3,125,277 | 3/1964 | Kozlowski | 206/45.14 |
| 3,245,526 | 4/1966 | Palmer | 206/45.31 |
| 3,361,227 | 1/1968 | Waldrop | 229/156 |
| 3,487,922 | 1/1970 | Peck | 206/45.14 |
| 3,521,810 | 7/1970 | Boyer | 229/23 |
| 3,679,093 | 7/1972 | Chang | 229/1.5 C |
| 3,946,870 | 3/1976 | Gajer et al. | 206/471 |
| 4,374,560 | 2/1983 | Howlett | 206/44 |
| 4,405,044 | 9/1983 | Flower et al. | 206/44.12 |
| 4,872,551 | 10/1989 | Theros | 206/471 |
| 5,098,391 | 3/1992 | Pantages et al. | 206/563 |

*Primary Examiner*—Paul T. Sewell
*Assistant Examiner*—Marie Denise Patterson
*Attorney, Agent, or Firm*—Bullwinkel Partners, Ltd.

[57] ABSTRACT

A container for packaging and displaying cutlery and the like having a display area for displaying one of the items contained therein. The container allows a consumer to touch and feel the handle of the item on display while preventing easy removal of the item from the container. The container comprises an outer box and an integrated inner tray holder formed from a single blank of flexible material. The outer box comprises a rear panel, top and bottom flaps hingedly connected to the rear panel, a front panel having a window, top and bottom flaps hingedly connected to the front panel, an outer right side panel and a left side panel. The integrated inner tray holder is hingedly connected to the rear panel along a foldline and comprises an inner right side panel, a tray holder bottom panel, a tray holder side panel and a joiner panel. Where the item on display is a knife, the knife is affixed to a tray by a plastic sheath and a tie. The plastic sheath covers the blade portion of the knife, allowing the consumer to touch and feel the knife handle.

1 Claim, 4 Drawing Sheets

Fig. 5
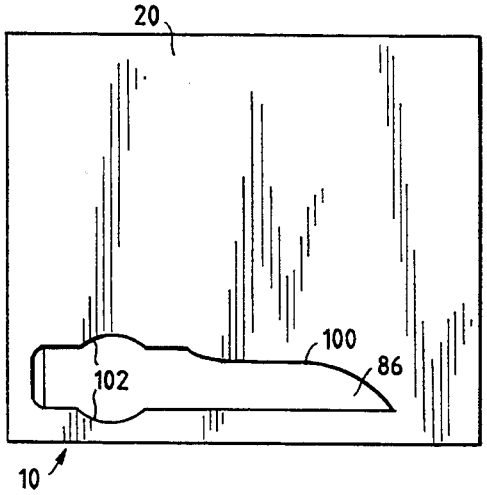
Fig. 8
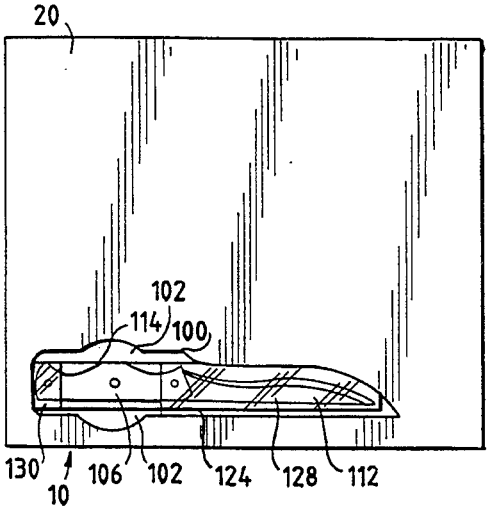
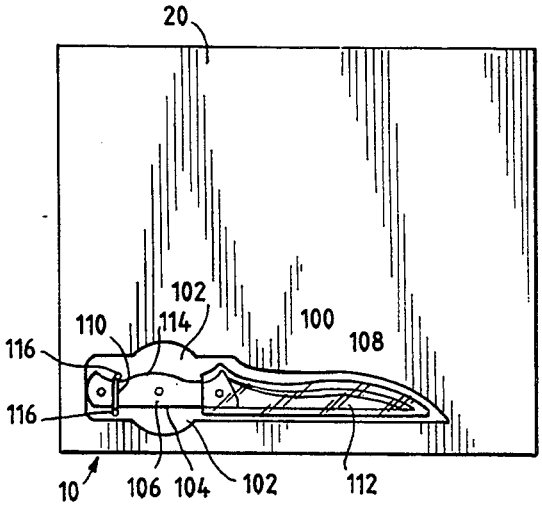
Fig. 6
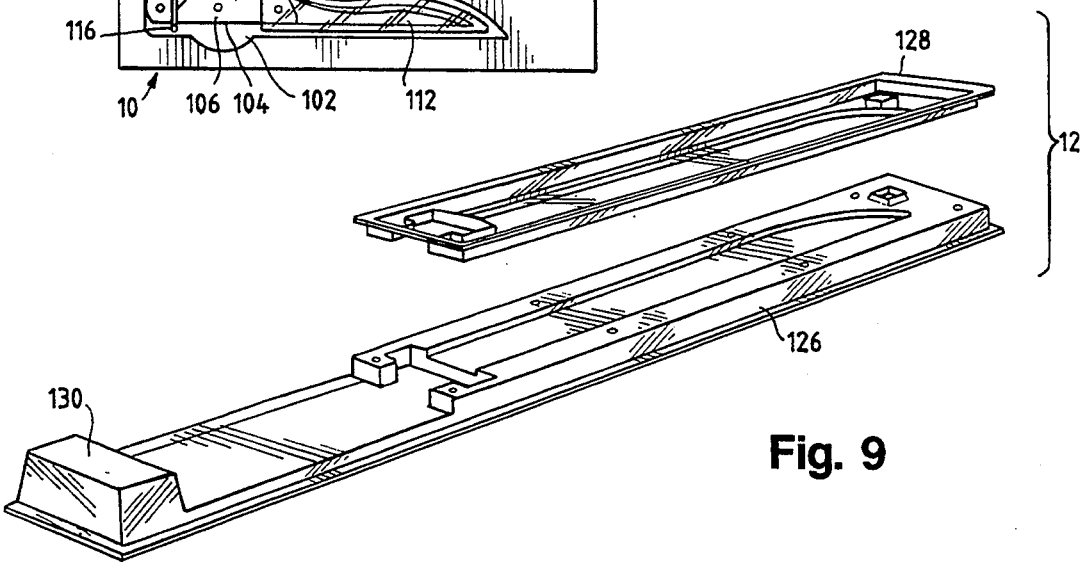
Fig. 9

CUTLERY AND ACCESSORY PACKAGING AND DISPLAY CARTON

BACKGROUND

1. Field Of The Invention

This patent relates to display containers. More particularly, this patent relates to a container for packaging and displaying sets of cutlery or other accessories.

2. Description Of The Related Art

In the packaging of sets of cutlery or other accessories for sale purposes, it is advantageous that the container incorporate an outer display window located on one side of the carton to show a sample of the items contained therein and an integrated inner tray holder upon which the sample is displayed. It is also advantageous that the container allow the consumer the ability to touch and feel the actual cutlery or accessory handle while preventing easy removal of the item from the container. This touch and feel feature is known to be a popular selling point for cutlery and other kitchen accessories. While containers having window displays are commonly known, no prior container of this general type is known that embodies and possesses all the aforementioned characteristics.

SUMMARY OF THE INVENTION

The present invention is a container for packaging and displaying sets of cutlery and the like comprising an outer box and an integrated inner tray holder formed from a single blank of flexible material. The outer box comprises a rear panel, top and bottom flaps hingedly connected to the rear panel, a front panel having a window for displaying one item from the set of cutlery and the like contained therein, top and bottom flaps hingedly connected to the top panel, and outer right side and left side panels. The integrated inner tray holder is hingedly connected to the rear panel along a foldline and comprises an inner right side panel, a tray holder bottom panel, a tray holder side panel and a joiner panel. The tray holder bottom panel, tray holder side panel, outer right side panel, front panel and front panel top and bottom flaps define a display area in which a knife or like item may be displayed.

In the preferred embodiment, the container is used in conjunction with a tray. The knife or other accessory on display is secured to the tray, preferably by means of a plastic sheath and a locking plastic tie. Where a knife is the item on display, the plastic sheath covers at least the knife blade and preferably a portion of the knife handle, and is affixed to the tray by adhesive or other means.

The present invention may be used to attractively package and safely display any sharp object of merchandise, such as knives, shears, scissors, peelers or other kitchen accessories.

It is an object of the present invention to provide an improved merchandise display container which allows the customer to touch and feel the merchandise without being able to remove it without fully opening the container.

A further object is to provide an improved container for sharp objects, such as cutlery, which permits a consumer to touch and feel the handle of the sharp object while protecting the consumer against injury due to inadvertent contact with the cutlery blade.

A still further object is to provide an improved container which is inexpensive to manufacture and quickly and easily assembled.

Further and additional objects will appear from the description, accompanying drawings, and appended claims.

BRIEF DESCRIPTION OF THE DRAWINGS

FIG. 5 is a front plan view of the carton of FIG. 1, with the top of the carton to the right;

FIG. 6 is a front plan view of the carton of FIG. 1, with the top of the carton to the right, shown displaying a knife contained within a plastic sheath;

FIG. 8 is a front plan view of the carton of FIG. 1, with the top of the carton to the right, shown displaying a knife within a plastic knife tray; and FIG. 9 is a perspective view of the plastic knife tray shown in FIG. 8.

DETAILED DESCRIPTION OF THE INVENTION

Figure 1:
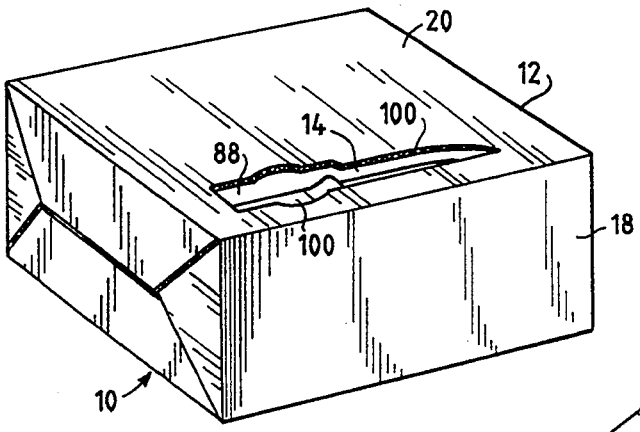
FIG. 1 is a perspective view of the cutlery and accessory packaging and display carton of the present invention.
Figure 2:
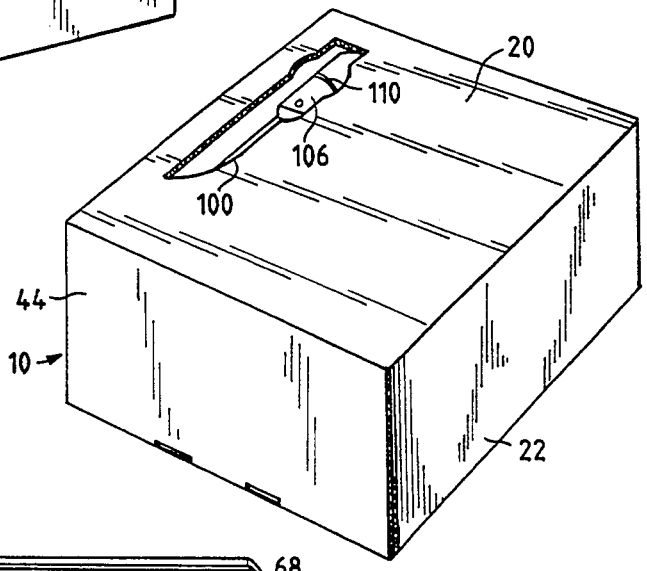
FIG. 2 is another perspective view of the carton of FIG. 1.
Figure 3:
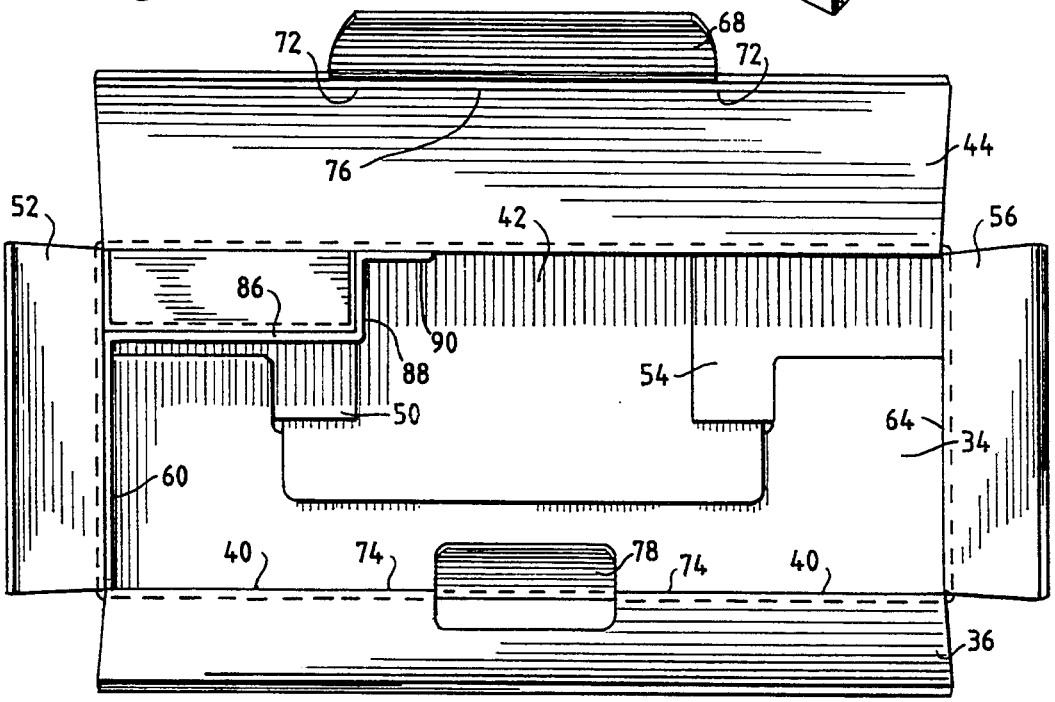
FIG. 3 is a top view of the carton of FIG. 1, shown partially unfolded to reveal the integrated inner tray holder.

Turning to the drawings, there is shown in FIG. 1 one embodiment of a cutlery and accessory packaging and display carton 10 according to the present invention. The carton 10 comprises an outer box 12 and an integrated inner tray holder 14. Both the outer box 12 and the inner tray holder 14 are formed from a single blank 16 (best shown in FIG. 4) of single-ply, double-faced, corrugated paperboard, or similarly suitable material.

Figure 4:
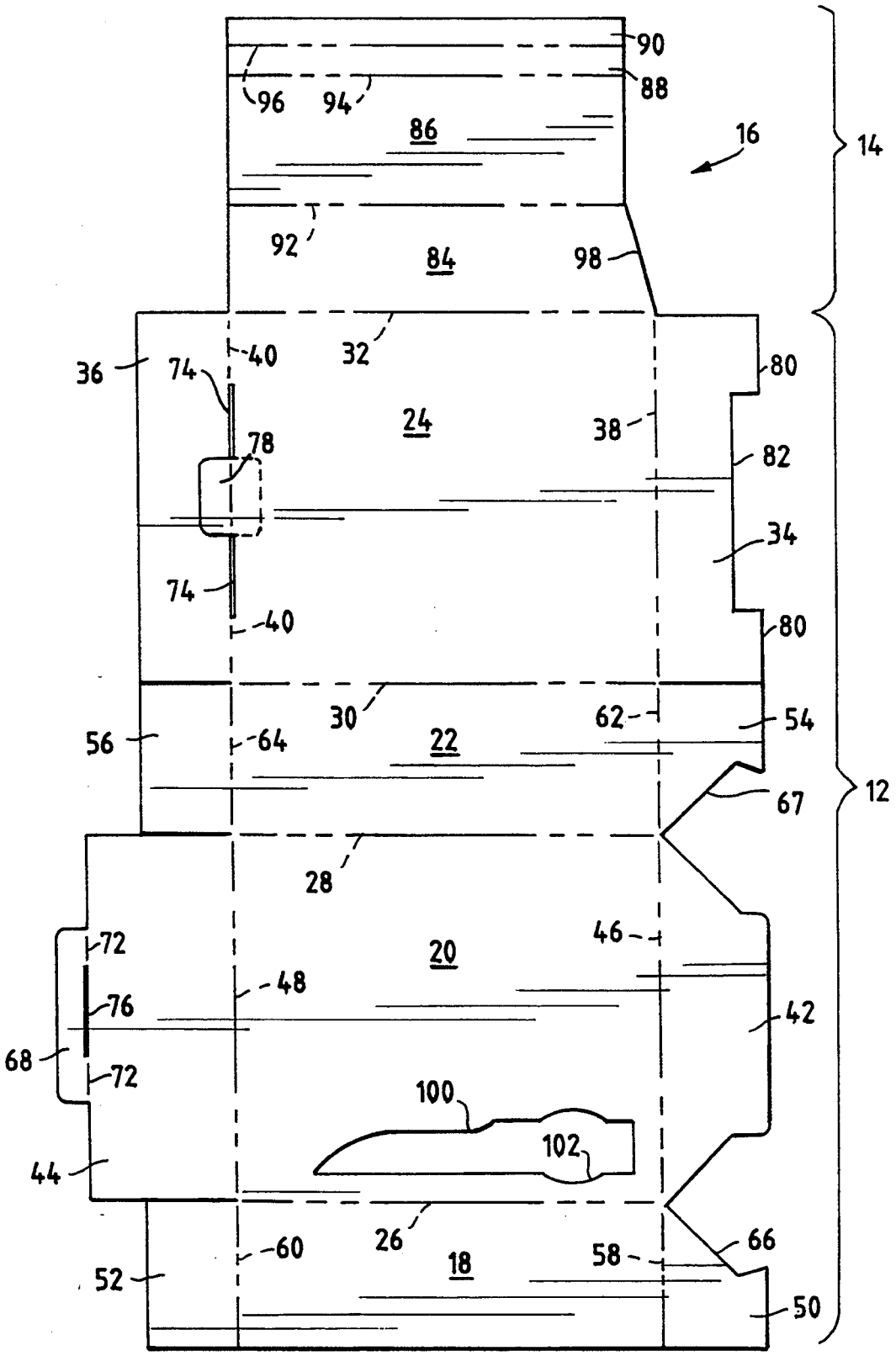
FIG. 4 is a bottom plan view of a blank from which the carton of FIG. 1 is formed.

The portions of the blank 16 from which the outer box 12 is formed include an outer right side panel 18, front panel 20, left side panel 22, and rear panel 24 separated by foldlines 26, 28, 30, 32 as shown in FIG. 4. Front panel 20 and rear panel 24 have vertical and horizontal dimensions. The foldlines 26, 28, 30, 32 are disposed in spaced parallel relation. A rear panel bottom flap 34 and a rear panel top flap 36 are connected by foldlines 38, 40 respectively to opposite side edges of the rear panel 24. Similarly, a front panel bottom flap 42 and a front panel top flap 44 are connected by foldlines 46, 48 respectively to opposite side edges of the front panel 20. Smaller flaps 50, 52 and 54, 56 are connected by foldlines 58, 60 and 62, 64 to opposite side edges of the outer right side panel 18 and the left side panel 22 respectively.

Flaps 50, 54 are provided with notches 66 and 67 respectively to facilitate easier assembly as described more fully hereafter. Extending from the outer edge 70 of front panel top flap 44 opposite foldline 48 is a large locking tab 68. Locking tab 68 runs along a portion of the outer edge of front panel top flap 44 and is connected thereto along foldline 72. Locking tab 68 is configured for easy insertion into slot 74 cut along foldline 40. Similarly, slot 76 is cut along foldline 72 for receiving sheared locking tab 78. Locking tab 78 is sheared from the rear panel 24 and rear panel top flap 36 and is hingedly connected to the rear panel 24.

Rear panel bottom flap 34 has an outer edge 80 opposite foldline 38 provided with a centrally-disposed notch 82 for insertion of front panel bottom flap 34 in the assembled carton 10. Front panel bottom flap 42 is appropriately configured for easy insertion into notch 82.

Looking at blank 16 in FIG. 4, the inner tray holder 14 is connected to the rear panel 24, and thus outer box 12, along foldline 32. The portions of the blank 16 from which the inner tray holder 14 is formed include an inner right side panel 84, a tray holder bottom panel 86, a tray holder side panel 88 and a joiner panel 90. Inner right side panel 84, tray holder bottom panel 86, tray holder side panel 88 and joiner panel 90 are connected by parallel score lines 92, 94, 96 respectively.

Inner right side panel 84 is cut diagonally along one edge 98 to facilitate easy assembly. The width of inner right side panel 84 extending from foldline 32 to score line 92 is shorter than the width of outer right side panel 18 so as to provide, in the assembled carton, sufficient space for the item on display on the inner tray holder 14. In the preferred embodiment where a knife is the item to be displayed, this difference in widths is about one inch, or slightly greater than the thickness of the knife handle.

A die cut window opening 100 is disposed in front panel 20 so as to provide means by which a consumer can view the sample item displayed therein. The window opening 100 is provided with finger notches 102 to allow the consumer to touch and feel the handle of the item on display. The shape of the window opening may vary according to the type of item on display. In the illustrated embodiment, a knife-shaped window opening is shown. The window may also be cut so as to allow the background of the display (i.e., the surface of tray holder bottom panel 86) to be used for graphics to enhance the display.

The carton 10 may be readily assembled in the following manner. Blank 16 is folded along foldlines 26, 28, 30 and 32 so as to bring outer right side panel 18 into juxtaposition with inner right side panel 84 and the two panels are be attached by adhesive or other suitable means. At about the same time, inner tray holder 14 is folded along score lines 92, 94 and 96 so as to bring joiner panel 90 into juxtaposition with the underside of front panel 20 for attachment by adhesive or other suitable means.

Flaps 50 and 54 are folded inward along foldlines 58 and 62 respectively. Rear panel bottom flap 34 and front panel bottom flap 42 are brought together by folding along foldlines 38 and 46 respectively, with rear panel bottom flap 34 being tucked into notch 82 in front panel bottom flap 42.

On the side of the carton opposite side flaps 34 and 42, flaps 52 and 56 are folded inward along foldlines 60 and 64 respectively. Rear panel top flap 36 and front panel top flap 44 are brought together by folding along foldlines 40 and 48 respectively. Locking tab 68 is inserted into slot 74, and sheared locking tab 78 is inserted into slot 76.

Of course, prior to final assembly, the items to be packaged are placed and secured inside the carton and a sample is placed and secured in the display area.

Figure 7:
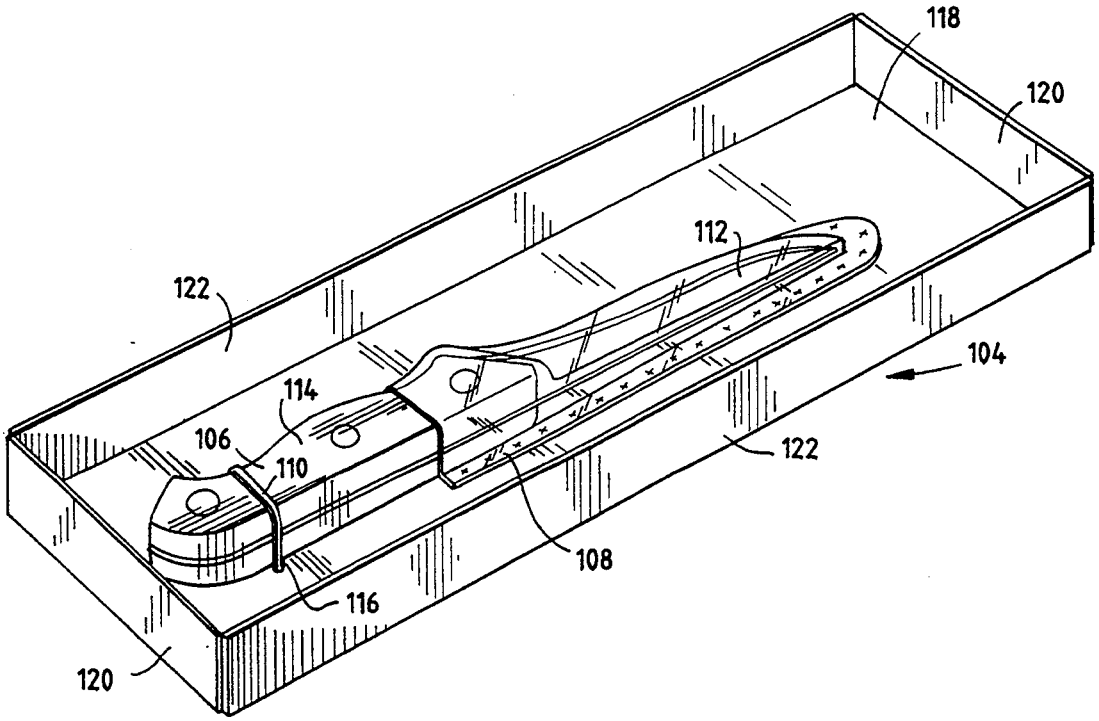
FIG. 7 is a perspective view of the knife and plastic sheath of FIG. 6.

In the preferred embodiment, when used to contain knives, the carton 10 is used in conjunction with a tray 104. A knife 106 is secured to the tray 104, preferably by means of a transparent plastic sheath 108 and a locking plastic tie 110. The plastic sheath 108 covers at least the knife blade 112 and preferably a portion of the knife handle 114, and is affixed to the tray 104 by adhesive or other means. The locking plastic tie 110 secures the knife handle 114 to the tray 104. Holes 116 located in the tray 104 accommodate the locking plastic tie 110 as best shown in FIG. 7.

While allowing a consumer to see the knife 106 and touch and feel the knife handle 114, the window opening 100 nevertheless is substantially smaller than the tray 104 so that the knife (or other item on display) cannot easily be removed through the window opening 100.

The tray 104 is preferably made of cardboard, and has a bottom 118, and two end panels 120 and two side panels 122 hingedly connected to the bottom 118 by folds. The length and width of the bottom 118 are substantially the same as the length and width of tray holder bottom panel 86. In addition, the width of tray side panels 122 are substantially the same as the width of the tray holder side panel 88. As a consequence, the tray 104 is held snugly within the display area and does not slide around. This configuration also helps assure that the knife 106, which is attached to the tray 104, cannot be easily removed from the display area without opening the carton 10.

Alternatively, the cutlery and accessory packaging and display carton 10 may be used in conjunction with a two piece plastic knife tray 124 as shown in FIGS. 8 and 9. The knife tray 124 is a sandwich type tray and comprises a bottom 126 and a lid 128. The knife 106 is held between the bottom 126 and the lid 128. A portion 130 of the bottom 126 covers the end of the knife handle 114 opposite the blade 112, but leaves most of the knife handle exposed. In this way a consumer can still touch and feel the knife handle 114. The tray bottom 126 is securely affixed to the tray holder bottom panel 86 by adhesive or other suitable means so that the knife cannot easily be removed from the carton 10. The lid 128 preferably is transparent and covers the knife blade 112.

Other modifications and alternative embodiments of the invention are contemplated which do not depart from the spirit and scope of the invention as defined by the foregoing teachings and appended claims. For example, a piece of transparent material such as cellophane may be used to cover a portion of the window opening 100, providing still further protection against removal of the item within and, in the case of sharp implements, inadvertent contact with the sharp end or edge of the implement.

The improved carton is inexpensive to manufacture and quick and easy to assemble. The carton includes novel structural features, including an integrated inner tray holder defining a display area and a window opening through which a consumer can look at a sample of the items contained therein. In addition, the carton allows the consumer to touch and feel the handle of the item, while providing safeguards against the removal of the item or, in the case of sharp instruments, accidental contact with the sharp portion of the instrument.

I claim as my invention:

1. In combination, a container for packaging and displaying cutlery and an item of cutlery;

said container comprising an outer box, an integrated inner tray holder formed from a single blank of flexible material, and a tray;

said outer box comprising a rear panel having horizontal and vertical dimensions, rear panel top and bottom flaps hingedly connected to opposite edges of the rear panel along horizontal foldlines, a front panel having horizontal and vertical dimensions and having a window for displaying an item of cutlery contained therein, front panel top and bottom flaps hingedly connected to opposite edges of the front panel along horizontal foldlines, a left side panel hingedly connected to the rear panel and front panel along vertical foldlines, and an outer right side panel hingedly connected to the front panel along a vertical foldline;

said integrated inner tray holder comprising an inner right side panel hingedly connected to the edge of the rear panel along a vertical foldline opposite the left side panel, a tray holder bottom panel hingedly connected to the inner right side panel along a vertical score line and having vertical and horizontal dimensions, a tray holder side panel hingedly connected to the tray holder bottom panel along a vertical score line, and a joiner panel hingedly connected to the tray holder side panel along a vertical foldline, wherein said tray holder bottom panel, tray holder side panel, outer right side panel, front panel, and front panel top and bottom flaps define a display area visible through the front panel window;

said tray disposed within the display area and comprising a bottom having a length and width substantially the same as the vertical and horizontal dimensions respectively of the tray holder bottom panel, and two end panels and two side panels hingedly connected to the tray bottom by folds, said tray side panels having a width substantially the same as the tray holder side panel;

wherein said cutlery item has a handle and a blade and is secured to said tray by a plastic sheath and a tie, said plastic sheath being affixed to the tray bottom and covering the cutlery item blade but leaving the cutlery handle substantially exposed so as to allow a consumer to touch and feel the cutlery item handle while preventing inadvertent contact with the blade.

* * * * *

UNITED STATES PATENT AND TRADEMARK OFFICE

CERTIFICATE OF CORRECTION

PATENT NO. : 5,375,700

DATED : December 27, 1994

INVENTOR(S) : Mike Joss, Gordon Ruhnke & Dave Sarmento

It is certified that error appears in the above-identified patent and that said Letters Patent is hereby corrected as shown below:

Column 4,

Claim 1, line 65: Replace ";" with ":".

Signed and Sealed this

Fifth Day of December, 1995

*Attest:*

*Attesting Officer*

Bruce Lehman

BRUCE LEHMAN

*Commissioner of Patents and Trademarks*